US006372046B1

(12) United States Patent
Gottwald et al.

(10) Patent No.: US 6,372,046 B1
(45) Date of Patent: Apr. 16, 2002

(54) DEVICE FOR THE DIRECT OR INDIRECT APPLICATION OF A LIQUID OR VISCID COATING MEDIUM ONTO A MOVING MATERIAL WEB

(75) Inventors: Ingo Gottwald, Steinheim; Bernhard Kohl; Stefan Reich, both of Heidenheim; Benjamin Méndez-Gallon, Itzelberg; Richard Bernert, Giengen; Martin Kustermann, Heidenheim; Manfred Ueberschär, Gerstetten; Christoph Henninger; Ruediger Kurtz, both of Heidenheim; Harald Hess, Grünkraut, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/337,859

(22) Filed: Jun. 21, 1999

(30) Foreign Application Priority Data

Jun. 22, 1998 (DE) ..... 198 27 712

(51) Int. Cl.[7] ..... B05C 5/02

(52) U.S. Cl. ..... 118/410; 118/419; 118/428; 118/33; 118/126

(58) Field of Search ..... 118/33, 63, 126, 118/248, 252, 253, 256, 410, 419, 428; 427/356, 358, 428

(56) References Cited

U.S. PATENT DOCUMENTS

| | | | | |
|---|---|---|---|---|
| 3,083,685 A | * | 4/1963 | Colgan | 118/126 |
| 3,113,884 A | * | 12/1963 | Kohler | 427/356 |
| 4,357,373 A | * | 11/1982 | Cooper | 118/126 |
| 4,601,256 A | * | 7/1986 | Poterala | 118/126 |
| 4,712,506 A | | 12/1987 | Rantanen et al. | 118/103 |
| 5,368,893 A | | 11/1994 | Sommer, et al. | 427/348 |
| 5,674,551 A | * | 10/1997 | Koskinen et al. | 118/126 |
| 5,683,509 A | | 11/1997 | Sollinger et al. | 118/227 |
| 5,865,944 A | * | 2/1999 | Reiter | 156/578 |
| 6,123,770 A | | 9/2000 | Koskinen, et al. | 118/110 |

FOREIGN PATENT DOCUMENTS

| | | |
|---|---|---|
| DE | PS 960 332 | 3/1957 |
| DE | 37 14 498 A1 | 5/1987 |
| DE | 44 46 373 A1 | 6/1996 |
| DE | 196 27 470 A1 | 1/1998 |
| DE | 297 21 305 U1 | 4/1998 |
| EP | 0 651 095 A1 | 5/1995 |
| EP | 0 752 497 A2 | 1/1997 |
| EP | 0 770 730 A1 | 5/1997 |
| WO | WO 99/55966 | 11/1999 |

* cited by examiner

*Primary Examiner*—Laura Edwards
(74) *Attorney, Agent, or Firm*—Taylor & Aust, P.C.

(57) ABSTRACT

A device designed for coating a material web with a coating medium includes a coater, a metering/smoothing device positioned downstream of the coater in the direction of feed of the material web, at a certain distance from the coater, and a support roll around which the material web is guided. Moreover, the material web is guided around the support roll only in the area of the metering/smoothing device, and it traverses essentially in a straight line between the coater and the support roll. In accordance to a first aspect of this invention, a support arrangement supports the material web in the straight web section between the coater and the support roll. In accordance to a second aspect of this invention, devices are provided which stabilize the material web in the area where the web traverses in a straight line.

31 Claims, 8 Drawing Sheets

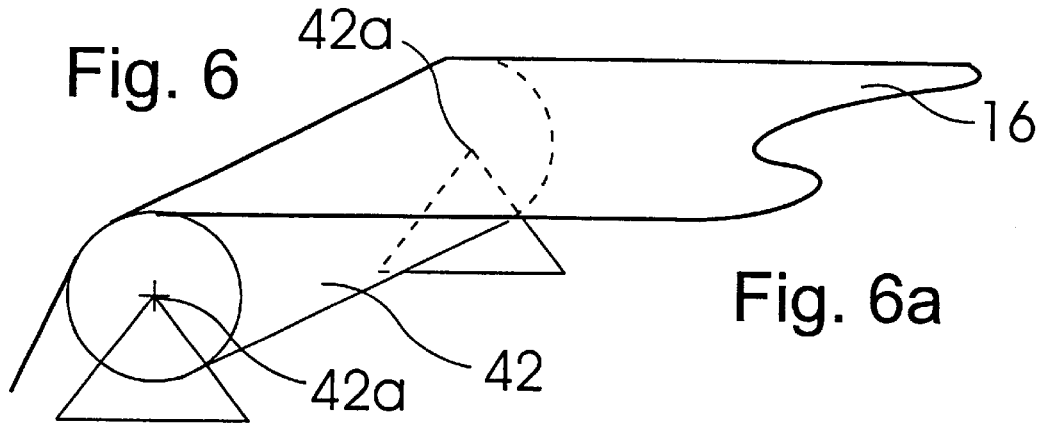
Fig. 6
Fig. 6a
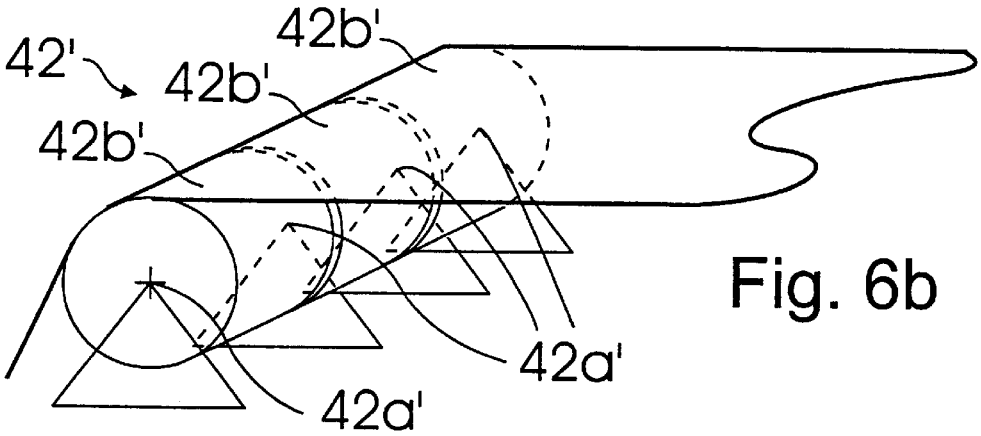
Fig. 6b
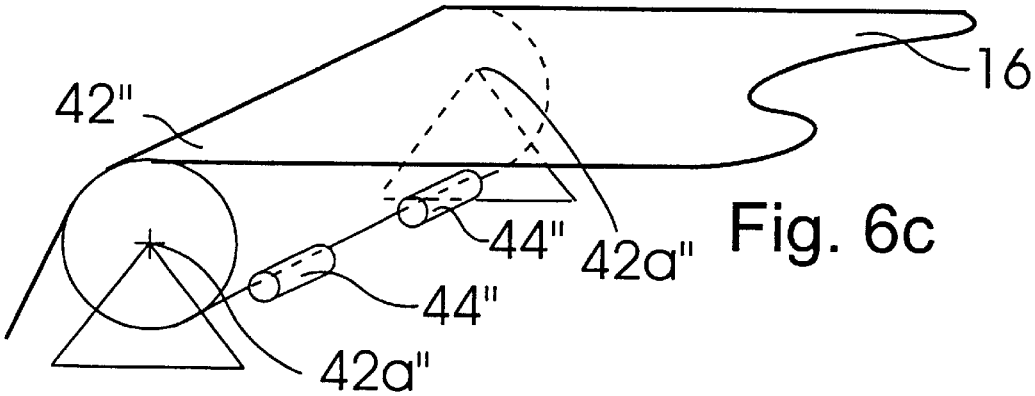
Fig. 6c
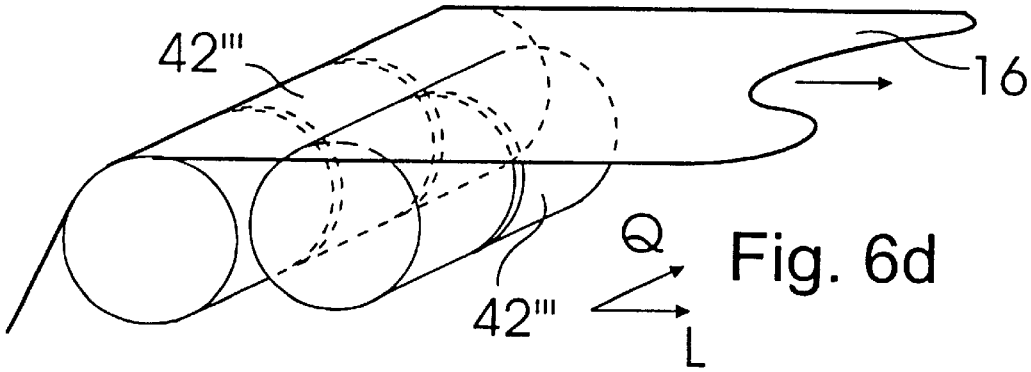
Fig. 6d

DEVICE FOR THE DIRECT OR INDIRECT APPLICATION OF A LIQUID OR VISCID COATING MEDIUM ONTO A MOVING MATERIAL WEB

BACKGROUND OF THE INVENTION

1. Field of the Invention

The present invention relates to device designed for the direct or indirect application of a liquid or viscid coating medium onto a moving material web, in particular, a substrate made of paper or carton. The device includes a coater for applying the coating medium directly or indirectly onto the material web, a device to meter and/or smooth (below referred to as metering/smoothing device), positioned downstream of the of the coater in the feed direction of the material web at a certain distance from the coater, and a support roll around which the material web is guided.

2. Description of the Related Art

A device for application of coating medium onto a web is known from European Patent Document EP 0 770 730 A1. With this device, the material web is guided around a support roll onto which the coater is mounted and serves to pre-meter and apply the liquid or viscid coating medium onto the material web. Additionally, the support roll holds the metering/smoothing device which performs the final metering of the pre-metered coating application, as well as the smoothing of the coating medium, if required. Because of the demands by paper and carton manufacturers to increase the material transfer speed, the state-of-the art coaters have the problem that the freshly-applied coating medium onto the material web is exposed to ever-increasing centrifugal forces. This increase in centrifugal force promotes the formation of projections on the coating layer, whereby the possibility exists that the metering/smoothing device is not capable of entirely smoothing out these projections, compromising the quality of the end product. Since the centrifugal force acting upon the coating medium changes with the square of the material speed and only linearly with the reciprocal value of the roll radius, the problem was partially addressed by increasing the roll radius. Hence, European Patent Document EP 0 690 172 A1 suggested to provide the coater and the metering/smoothing device with an additional support roll in order to allow the material web to traverse in an essentially straight line between the two support rolls. This solution, however, has the disadvantage of occupying a substantial amount of machine space because of the need to use two support rolls.

SUMMARY OF THE INVENTION

The present invention provides a generic coater that requires less machine space as compared to the state-of-the art equipment.

A generic device addresses this requirement in accordance to a first aspect of this invention, in which the material web is guided around the support roll only in the area of the metering/smoothing device. The material web traverses in a substantially straight line between the coater and the support roll, and a support arrangement supports the material web in the straight section between the coater and the support roll. This coater occupies relatively little machine space in the direction perpendicular to the feed direction of the material web and, moreover, stabilizes the movement of the material web in the section between the coater and the support roll.

In accordance to a first embodiment, the support arrangement can include a stationary support surface. This stationary support surface can be, for example, a substantially flat support plate on which the material web glides. It is, however, also feasible for the stationary support surface to be a textural support panel, whereby the texture is designed in such a way that an air cushion forms between the material web and the textural surface, on which air cushion the material web moves. Such an air cushion can be formed by air, for example, which is transported by the material web on its outer surface as a result of the boundary layer effect. The latter design has the advantage that the material web can move past the support arrangement substantially frictionlessly, despite the large flat area associated with the support structure.

Finally, it is also feasible to generate an air cushion by expelling air through nozzles which are distributed throughout the support surface, and thus evenly distributing the air across the entire support surface.

With the above mentioned embodiments, it is possible for the support arrangement to reach into the gore formed by the material web and the support roll in order to support the material web as closely as possible to the support roll and far into the metering/smoothing nip. The surface of the support arrangement facing the support roll can thereby be shaped as a flat surface. It is, however, preferred that the surface facing the support roll matches the peripheral shape of the support roll. This allows the surface to reach deep into the metering/smoothing nip. This design further allows a very close proximity between the outer surface of the support arrangement and the surface of the support roll, which has the additional advantage of disrupting the boundary layer formed by the air on the outer surface of the support roll.

A smooth interaction between the support arrangement and the material web can be further assured by providing the feed side of the support arrangement with an approach panel for the material web. The approach panel can be formed by either a rounded off edge, by a sloping panel member positioned at an acute angle relative to the material web, or by a polygon-shaped approach panel. Furthermore, such approach panels have the benefit of easing the feeding process of the material web and further, provide support in the area upstream of the coater.

The support arrangement can be designed as a sheet metal construction, preferably made from stainless steel.

In accordance to an additional embodiment, the support arrangement includes a circulating support belt whose surface facing the material web between the coater and the support roll forms a substantially flat surface. This embodiment also offers a support arrangement for the material web with little or no friction.

As a further development of this embodiment, the support belt is looped around the support roll which guides the material web in the area of the metering/smoothing device. This provides support for the material web all the way to the metering/smoothing device. A particularly stable support can be achieved by providing at least one saddle on the side of the support belt facing away from the material web. In addition, the material web can be, in accordance to this design, supported in the area upstream of the coater through appropriate sizing and placement of the support belt.

In accordance to an additional aspect of this invention, in a generic device, the material web is guided around the support roll only in the area of the metering/smoothing device. The material web traverses substantially in a straight line between the coater and the support roll, and means are provided stabilizing the material web in the straight section between the coater and the support roll. Surprisingly, it has become evident that an adequate stabilization of the material web in the area of the coater can be achieved not only by utilizing the especially provided support arrangement, but also by applying a pre-determined amount of tension to the material web in the area between coater and the metering/smoothing device. This allows the material web to enter past either the top side or the bottom side of a web guide element into the straight section. The material web contacts the web guide roll on its coating side or the side opposing the coating side.

Again, it is advantageous that the device to stabilize the material web provide the stabilization effect in the area ahead of the coater and/or all the way to the support roll.

The web guide roll can be created from an easy-running carrying roll, for example, in order to avoid affecting the tension applied to the material web provided by the device to stabilize or tension the material web. Furthermore, the desired tension can be favorably influenced by the manner in which the web guide roll is positioned.

For example, it is feasible that the web guide roll is designed to extend across the material web and be supported on its ends. It is furthermore advantageous to provide support rolls distributed along the length of the web guide rolls. By using such support rolls, web guide rolls such as light-weight carrying rolls with relatively small diameters can also be applied on material webs that are very wide. Furthermore, it is sensible to power the support rolls in order to reduce the friction between the web guide rolls and the support rolls.

For stabilizing the web guide roll, it can be—in accordance to another embodiment—grouped into a multitude of segments, each of them being supported on both of its ends. Such a segmented web guide roll can be followed by another segmented web guide roll. The segments of the second guide roll are offset in the transverse direction relative to the segments of the previous web guide roll.

In another embodiment, the coater can fulfill the function of the web guide element. In doing so, it is especially advantageous for the coater to be a free-jet type coating device since, with such free-jet coating devices, the material web is turned around by a coating medium cushion, comparable to a so-called "air-turn", in which the material web is turned around on a cushion of air. In some case, it can be advantageous for the coating medium to exit the free-jet coating device not only in direction of the web movement, but also in the opposite direction against the movement of the web—in order to obtain an especially stable coating medium cushion.

It should be further noted that in those cases where the function of web guide roll is carried out by the coater, the freshly applied coating medium is forced towards the material web as a result of the centrifugal forces which helps its adhesion to the material web.

In order to achieve the desired tension of the material web, it is further proposed that an additional web guide roll—preferable a spreader roll—is provided in the area of the coater, on the side of the material web facing away from the coater.

As part of a further development of this invention, it is suggested to make the reaction time—also referred to as "dwell time"—which is the amount of time available for the coating medium to bind to the material web in the area between the coating mechanism and the metering/smoothing device, adjustable. To do so, the position of the coater in the feed direction of the material web and/or the position of the metering/smoothing device in the feed direction of the material web around the support roll can be made to be altered. For changing the position of the coater and/or the metering/smoothing device, drive mechanisms of electric, hydraulic, pneumatic or hydro-pneumatic nature or means to be operated in a similar manner can be employed. These devices should be able to facilitate an adjustment even during operation of the coater.

Additionally, the position of the web guide roll can be adjustable in the feed direction of the material web. If, as indicated above, the position of the coater is adjustable, then the position of the web guide roll can be adjusted either independently from the adjustment of the coater or together with the coater. The latter case can be realized by mounting the support arrangement of the web guide rolls onto the coater or to a part, which is solidly attached to it.

The metering/smoothing device can include a doctor blade, a smooth or profiled doctor rod, an air blade or air knife or similar devices.

As already mentioned above, the coater can be of the free-jet type design. It has, independently of the use of such a coater as a web guiding element, the advantage that the jet's momentum acting upon the material web can additionally be used to maintain the desired tension of the material web without the presence of a support surface.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 6 includes FIGS. 6*a*–6*d* showing perspective views of a web guide roll;

FIG. 6*a* is a perspective view of one embodiment of an apparatus for supporting a web guide roll;

FIG. 6*b* is a perspective view of another embodiment of an apparatus for supporting a web guide roll;

FIG. 6*c* is a perspective view of yet another embodiment of an apparatus for supporting a web guide roll;

FIG. 6*d* is a perspective view of still another embodiment of an apparatus for supporting a web guide roll;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
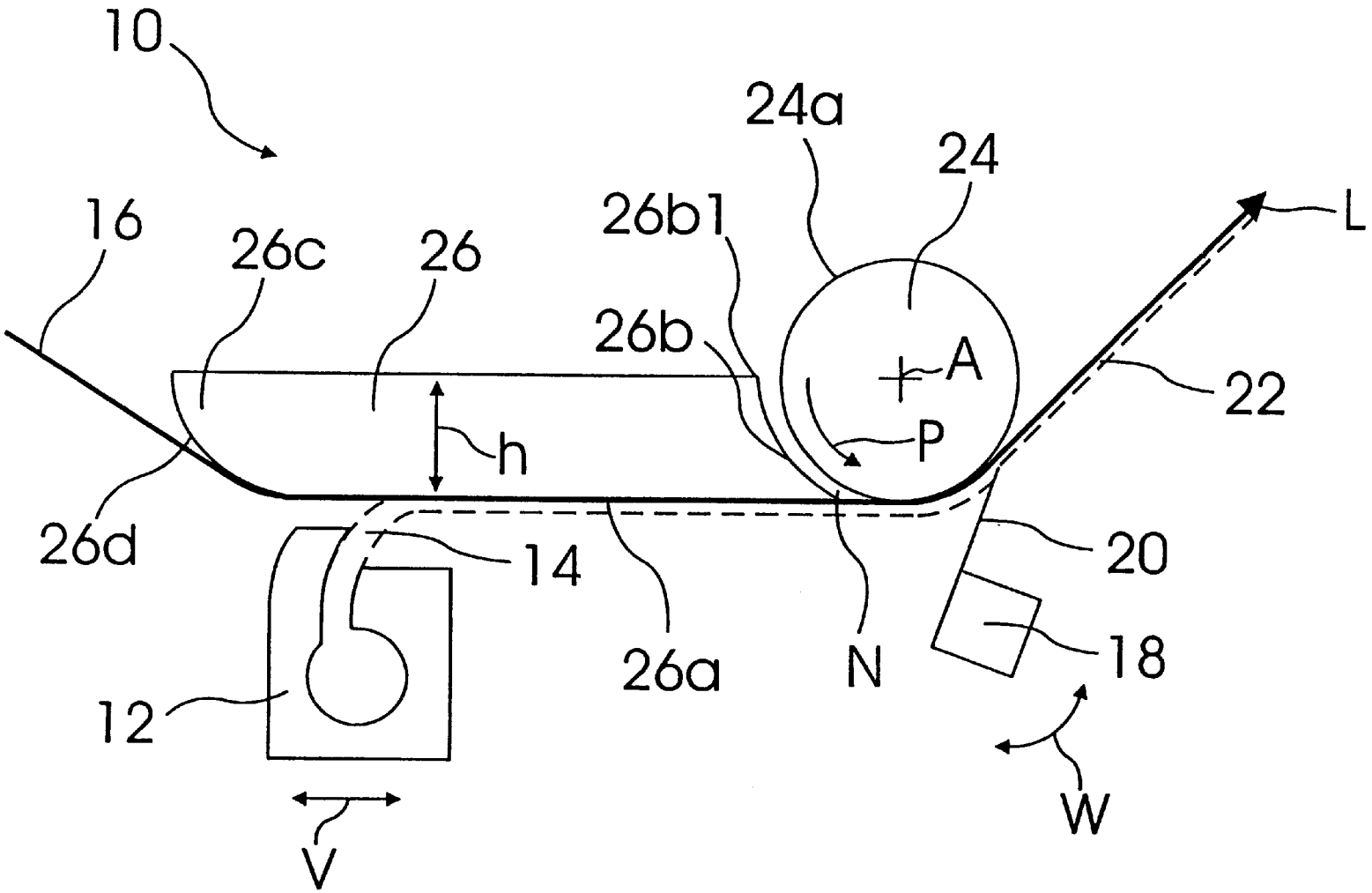
FIG. 1 is a schematic diagram of one embodiment of a coater with a support box, including a flat contact surface.

Referring now to the drawings and particularly to FIG. 1, a first embodiment of a coating machine designed in accordance to this invention is labeled with the reference number 10. It includes a coater 12 for applying pre-metered liquid or viscid coating medium 14 onto material web 16, moving in direction L. A metering/smoothing device 18, includes a doctor blade 20, for example, for the purpose of the final metering and smoothing of coating medium 22. As such, the doctor blade 20 removes the excess coating medium and smoothes the remaining coating medium on material web 16.

In the area of the blade coater 18, material web 16 is guided around support roll 24, which is turning around its axis A in direction as indicated by arrow P. Support roll 24 provides the support for material web 16 required to counteract the forces of the doctor blade acting upon the outer surface of the material web. Support roll 24 defines a feed-side gore with the material web. Support arrangement extends into the feed-side gore 26 is positioned ahead of support roll 24 with respect to the feed direction L, and can be of a box-type sheet metal construction, preferably made from stainless steel.

Support box 26 includes a substantially flat support surface 26*a* on which the material web 16 glides. Support surface 26*a* extends from coater 12 to support roll 24 and at least partially into the nip N formed between the outer surface 24*a* of support roll 24 and material web 16. To do this, a limiting panel 26*b* of support box 26 is fitted adjacent to support roll 24 to match or conform to the periphery or peripheral surface 24*a* of support roll 24, meaning this panel 26*b* is rounded using an appropriate radius. This makes it possible for the support surface 26*a* to reach far into the nip N. Additionally, it allows a disruption of the boundary layer formed by air flowing across the surface 24*a* of support roll 24 by use of the upper edge 26*b*1 of the limiting panel 26*b* of the support box 26, thus preventing air from reaching into nip N. On its feed side 26*c*, the support box 26 includes an approach panel 26*d* which, in the embodiment of FIG. 1, not only serves the function of helping the material web 16 in its approach to the support box 26, but also helps guide the web and, therefore, is shaped as a curved surface with a correspondingly small radius of curvature.

As indicated in FIG. 1 with the double arrow V, the position of coater 12 can be adjusted in direction of feed L of the material web 16, which allows for a variation in the reaction time of coating medium 14 on material web 16 before reaching the metering/smoothing device 18. Another way of affecting the reaction time is to adjust metering/smoothing device 18 around axis A of support roll 24, as indicated in FIG. 1 by the double arrow W. In this context, it should be noted that the substantially flat support surface 26*a* should be dimensioned in terms of its length in direction of feed L of material web 16 so that adequate stabilization of material web 16 is consistently achieved in the area of coater 12 irrespective of an adjustment of coater 12.

As is evident from FIG. 1, support box 26 has a height h, which is dimensionally smaller than the diameter of the support roll 24. Because of the low construction height, the area above support box 16 is kept open for other uses.

Figure 2:
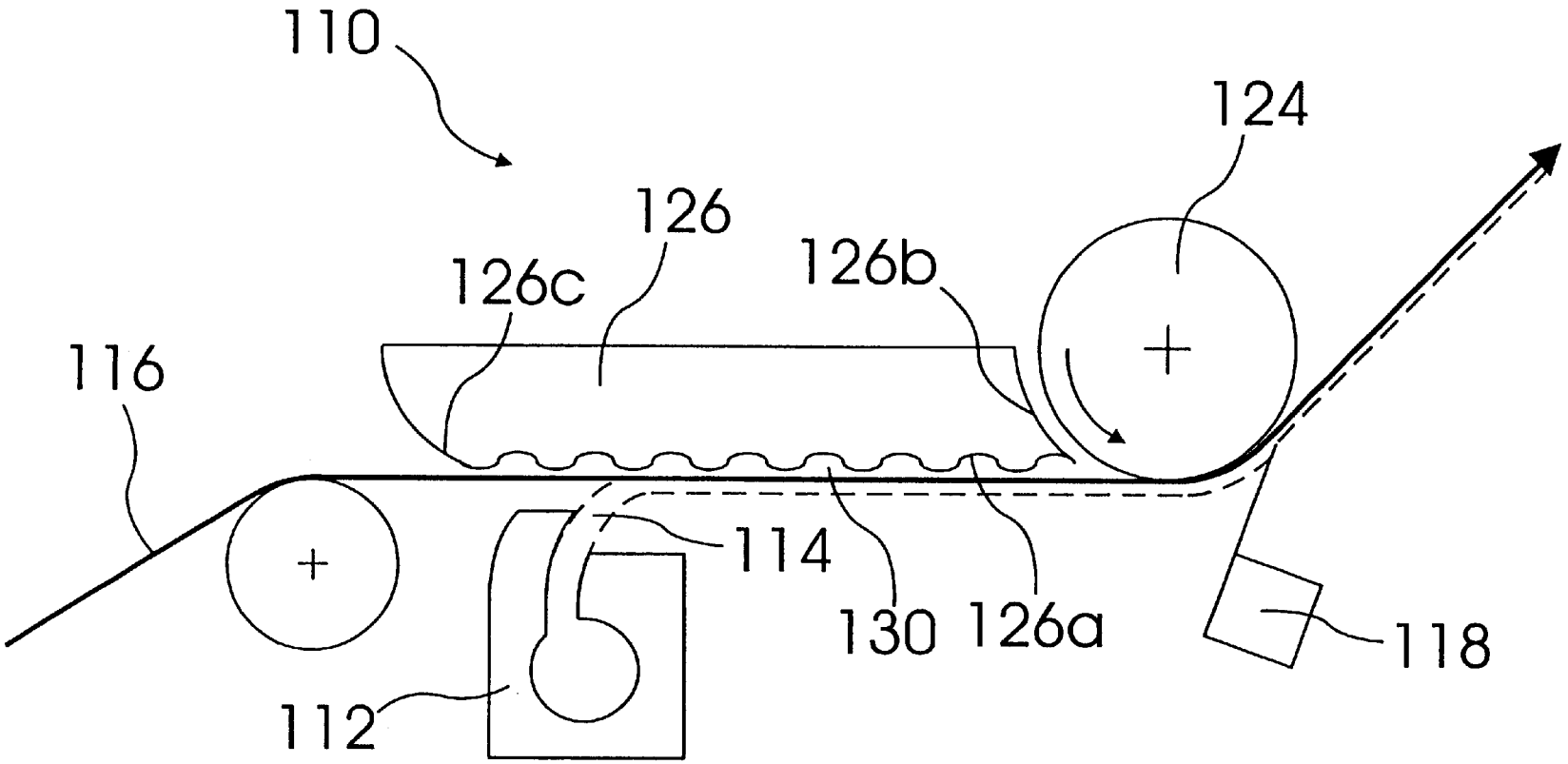
FIG. 2 is a schematic diagram of another embodiment of a coater with a support box, including a textural contact surface.

FIG. 2 illustrates another embodiment of a coater in accordance to the intent of this invention, which in essence, is the same as the one shown in FIG. 1. Therefore, the parts which are identical are labeled with the same reference number plus the number 100 added. Furthermore, the embodiment referenced in FIG. 2 is described only to the extent that it is different from the embodiment in FIG. 1, the description of which is hereby expressly referred to.

The coating machine 110, in accordance to FIG. 2 also includes a support arrangement 126 extending from the area of the coater 112 to the support roll 124 assigned to blade coater 118. FIG. 2 uses a support surface 126*a* of support arrangement 126 that is—unlike the surface depicted in FIG. 1—not flat but rather has a textural surface. The textural structure of support surface 126*a* is designed in such a way that the air being entered by the material web 116 into the area of the approach panel 126*c* of the support arrangement 126 between the support surface 126*a* and material web 116 forms a substantially uniform air cushion 130, on which material web 116 can traverse substantially friction-free. This has the advantage of generating lower stress levels and, therefore, lowers the risk of damaging the material web. In regards to additional design details—for example the design of limiting panel 126*b* facing support roll 124, reference is made to the discussion of the embodiment referenced in FIG. 1.

Figure 3:
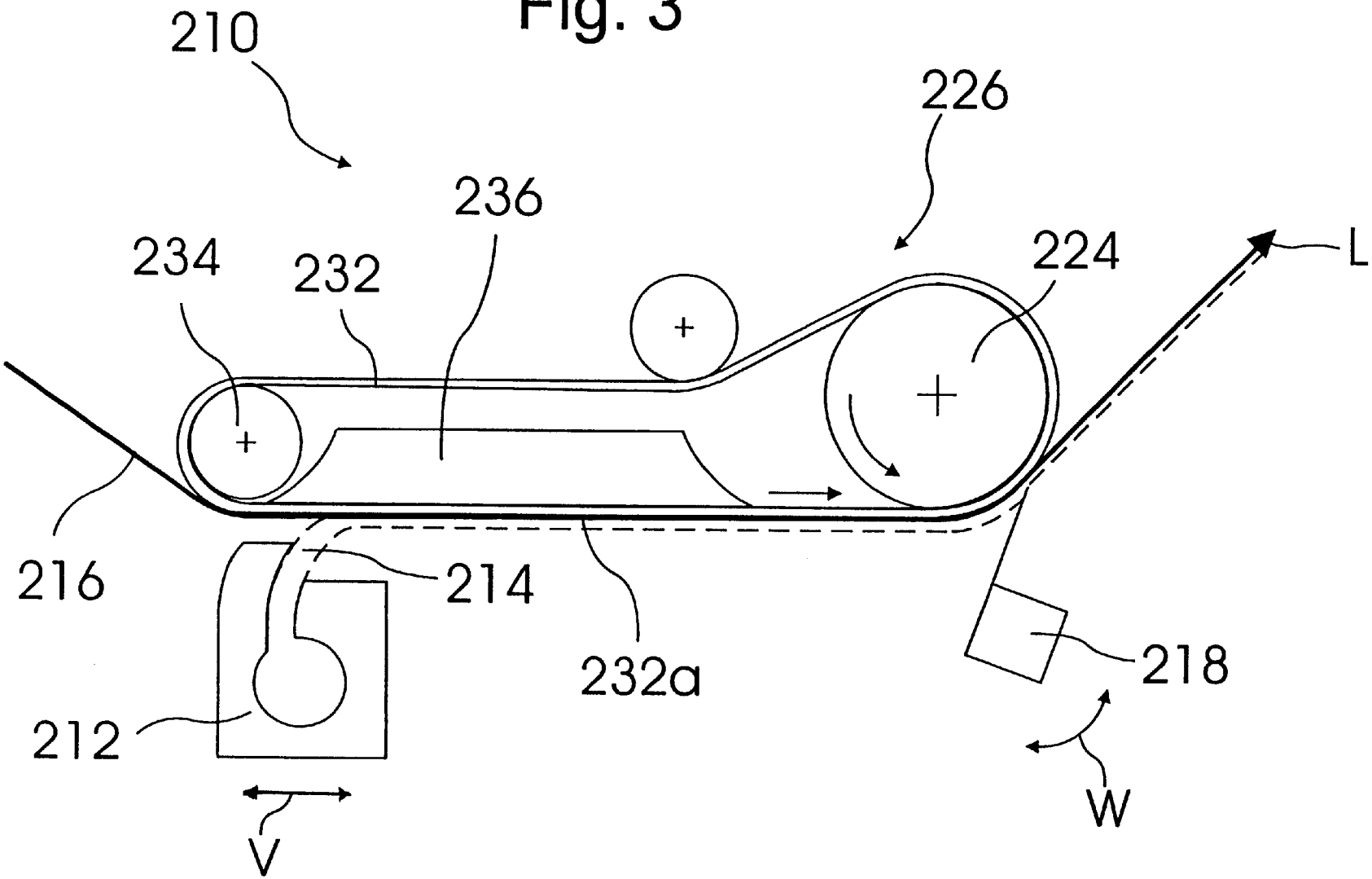
FIG. 3 is a schematic diagram of yet another embodiment of a coater, whose support arrangement includes a circulating support belt.

In FIG. 3, identical parts are labeled with the same reference numbers as used in FIG. 1 plus the number 200 added. In addition, the embodiment referenced in FIG. 3 is described only to the extent that it is different from the previous embodiments, the description of which is hereby referred to.

The coating machine 210, according to FIG. 3, includes a support arrangement 226 with a support belt 232 revolving around idler roll 234 on the feed side and around support roll 224 on the discharge side. The outer surface 232*a* of support belt 232 is in contact with material web 216 which is moving in concert with the belt 232 in feed direction L. Hence, the coating machine 210 also provides a substantially frictionless interaction between material web 216 and support arrangement 226. In order to provide a high degree of stabilization of support belt 232 in the area of the coater 212, the side of support belt 232 facing away from coater 212 is supported by saddle 236. This saddle, contrary to what is shown in the depiction in FIG. 3, can extend all the way to support roll 224.

Again, coater 212 and blade coater 218 can be adjusted in terms of their respective position in direction of feed L (arrows V and W), in order for the coating medium 214 being applied on the outer surface of the material web to receive the desired reaction time between coater 212 and doctor blade 218.

Figure 4:
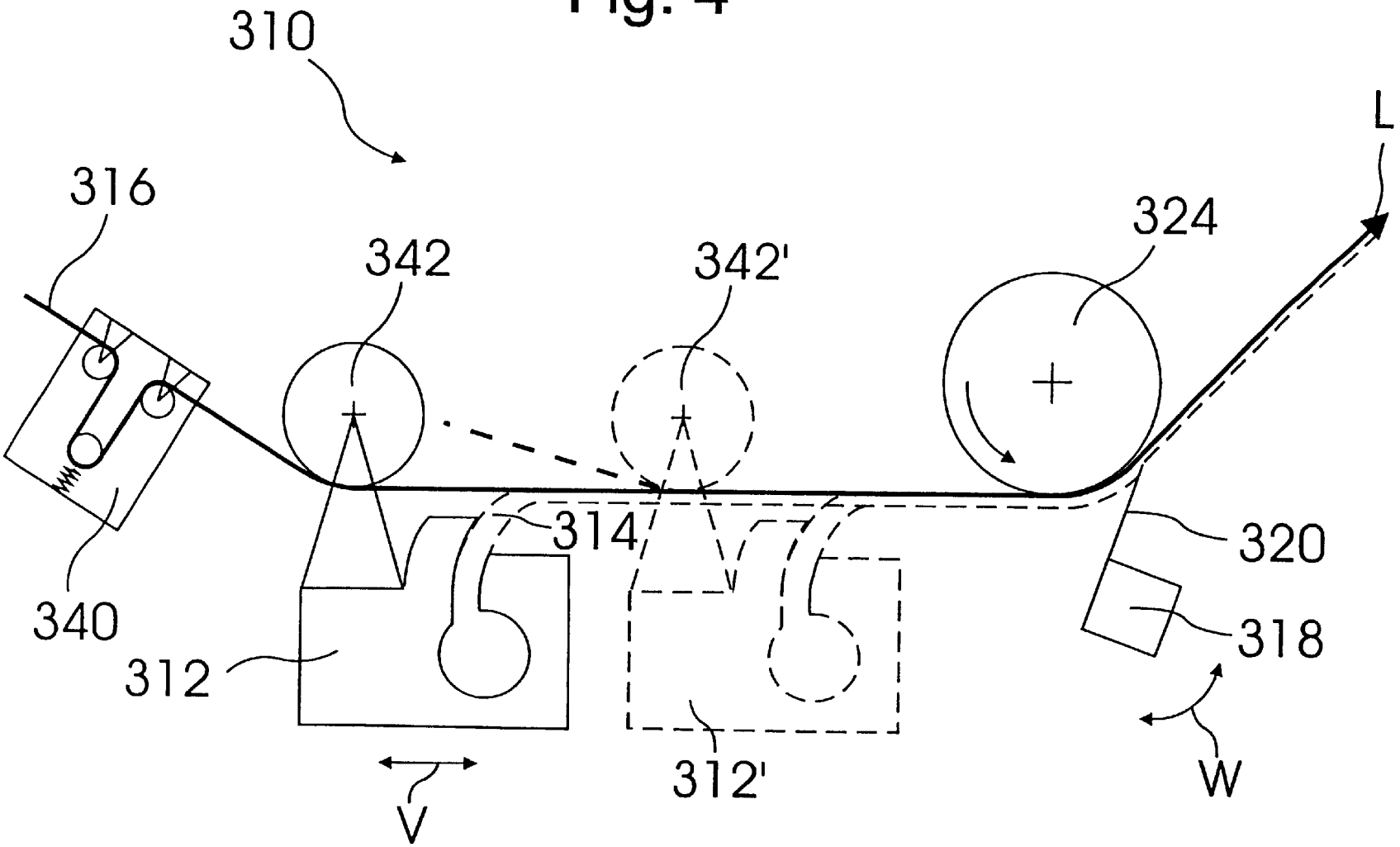
FIG. 4 is a schematic diagram of a further embodiment of a coater, without support arrangement, but with a tensioning device.

An additional embodiment of the coating machine, in accordance to the present invention is represented by FIG. 4. It is based on a different operating principal in that the coating medium is not applied on a supported section of the material web, but on an area of the web that is stabilized by simply applying an appropriate amount of tension to the web. Nevertheless, identical parts are labeled with the same reference numbers as used in FIG. 1 plus the number 300 added. Additionally, with respect to the basic design of the coating machine 310, the previous explanations of the embodiments according to FIGS. 1 through 3 apply.

With coating machine 310—according to the embodiment depicted in FIG. 4—the coating medium 314 is applied onto material web 316 by coater 312. Coating medium 314 then traverses together with material web 316 along a certain distance before it receives the final metering and smoothing by the metering/smoothing device 318 or the doctor blade 320. Material web 316 revolves around support roll 324, against which doctor blade 320 is positioned, in the region of the doctor device 318.

Before material web 316 reaches in feed direction L the area where the coater 312 is positioned, it runs through a tensioning device 340, which is shown in FIG. 4 only schematically. Device 340 assures that material web 316 receives a predetermined amount of tension in the area between web guide roll 342 and support roll 324. Surprisingly, experience has shown that the coating medium 314 can indeed be applied on a free-running material web 316, i.e., in a section of the web that has no support arrangement for coater 312, provided that the material web 316 is sufficiently tensioned.

It should be noted that tensioning device 340 is illustrated here simply as an example and for clarity, it is shown here as a type of a compensator roll. Fundamentally, it is also feasible to generate and maintain the appropriate amount of tension of material web 316 by a pre-determined difference in surface velocity between support roll 324 and web guide roll 342. Furthermore, "fixation sections", which tension the material web by use of speed-controlled rolls, which show a large angle of contact with the material web, can be positioned either before or after the coating machine. Such a "fixation section" can be integrated into a drying section downstream of the coating machine.

To adjust the reaction time, the position of the coater 312, as well as the position of the blade coater 318, can be changed in the feed direction of material web 316. This is indicated in FIG. 4 by the double arrows V and W. FIG. 4 also shows a second possible position for coater 312'.

Figure 5:
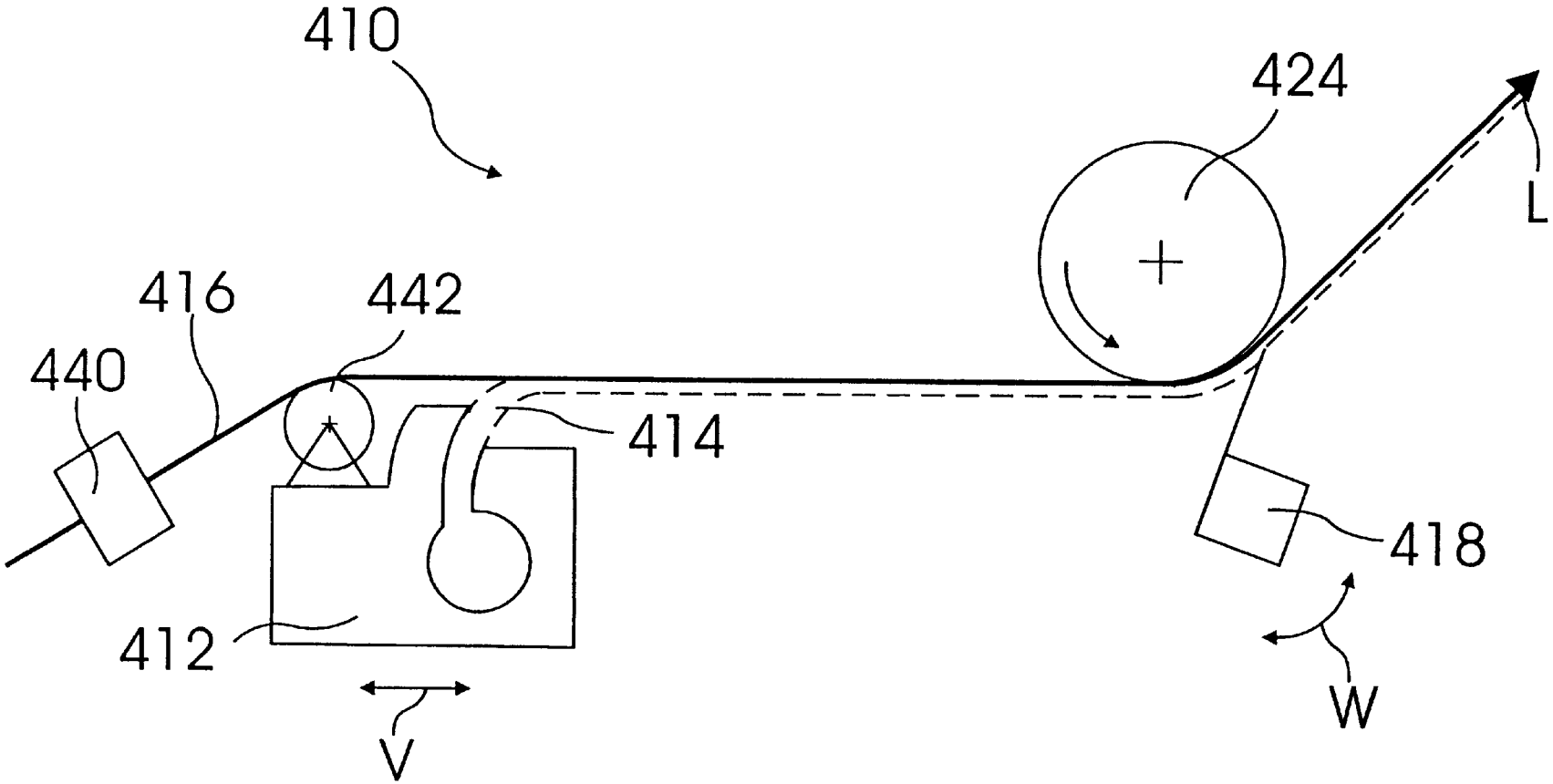
FIG. 5 is a schematic diagram of still another embodiment of a coater, similar to the one shown in FIG. 4, but with the web feed from below.

As can be visualized from the dashed depiction in FIG. 4, web guide roll 342 is moved together with the coater 312. By laterally moving coater 312 in the feed direction L of the web, the web section between the guide roll 342 and the coater 312 can be maintained at a short distance, so that material web 316 flexes only minimally in response to the pressures from the coating medium 314 being applied by coater 312. It should be noted that this pressure also contributes to the generation of the desired tension of material web 316. Coater 410, as depicted in FIG. 5, differs from coater 310 depicted in FIG. 4 only in that the material web 416 contacts the web guide roll 442 on the side of the material web which subsequently receives the coating medium 414 from coater 412. In the embodiment shown in FIG. 4 on the other hand, the material web 316 contacts the web guide roll with the side of the web opposing the coated side.

With respect to the tensioning device 440 of the blade coater 418, its support roll 424, as well as the explanation of the operation of the coating machine 410, the description of the coating machine 310 per FIG. 4 applies.

Web guide rolls 342 and 442 per the embodiments of FIGS. 4 and 5 are preferably light-weight carrying rolls which are not powered by an external drive but solely run on low friction bearings and coast together with the material web. FIG. 6 depicts several possibilities of arranging such light-weight carrying rolls.

According to FIG. 6*a*, monolithic light-weight carrying roll 42 extends in a direction corresponding to the width of the material web 16 and is only supported at its ends 42*a*.

According to FIG. 6*b*, light-weight carrying roll 42' is divided into a plurality of segments 42*b*, which are supported at their respective ends 42*a*'.

Light carrying roll 42", according to FIG. 6*c*, extends in the direction corresponding to the width the material web 16 and is supported at its ends 42*a*". In addition, light-weight carrying roll 42" is equipped with support rolls 44", which are powered in order to minimize the friction between themselves and the light-weight carrying roll 42". The support rolls 44" can be arranged on the feed side or on the discharge side of the light-weight roll 42". For clarity reasons, however, FIG. 6*c* shows support rolls 44" only on the discharge side. The application of support rolls 44" makes it possible to use light-weight carrying rolls 42" with small diameters, even on very wide machines.

Finally, a fourth alternative is shown in FIG. 6*d*. It depicts two segmented light-weight carrying rolls 42"', each of which corresponds in essence to the light-weight carrying roll 42' shown in FIG. 6*b*. The two segmented light-weight carrying rolls 42"' are positioned adjacent to one another along the feed direction L and are off-set relative to one another in the transverse direction as indicated by the arrow Q. In doing so, the light-weight carrying rolls 42"' provide a continuous support area for the material web 16.

Further to the embodiment in accordance to FIG. 5, it should be noted that web guide roll 442, similar to the embodiment shown in FIG. 4, is connected solidly with, or fixedly attached to, the coater 412, so that the web spacing between guide roll 442 and coater 412 is not changing in response to a lateral adjustment of coater 412 in direction indicated by arrow V. It should be noted, however, that it is fundamentally feasible to mount web guide roll 342 per FIG. 4, or 442 per FIG. 5, movable independently from the respective coater 312 or 412 along the feed direction L of the material web.

Figure 7:
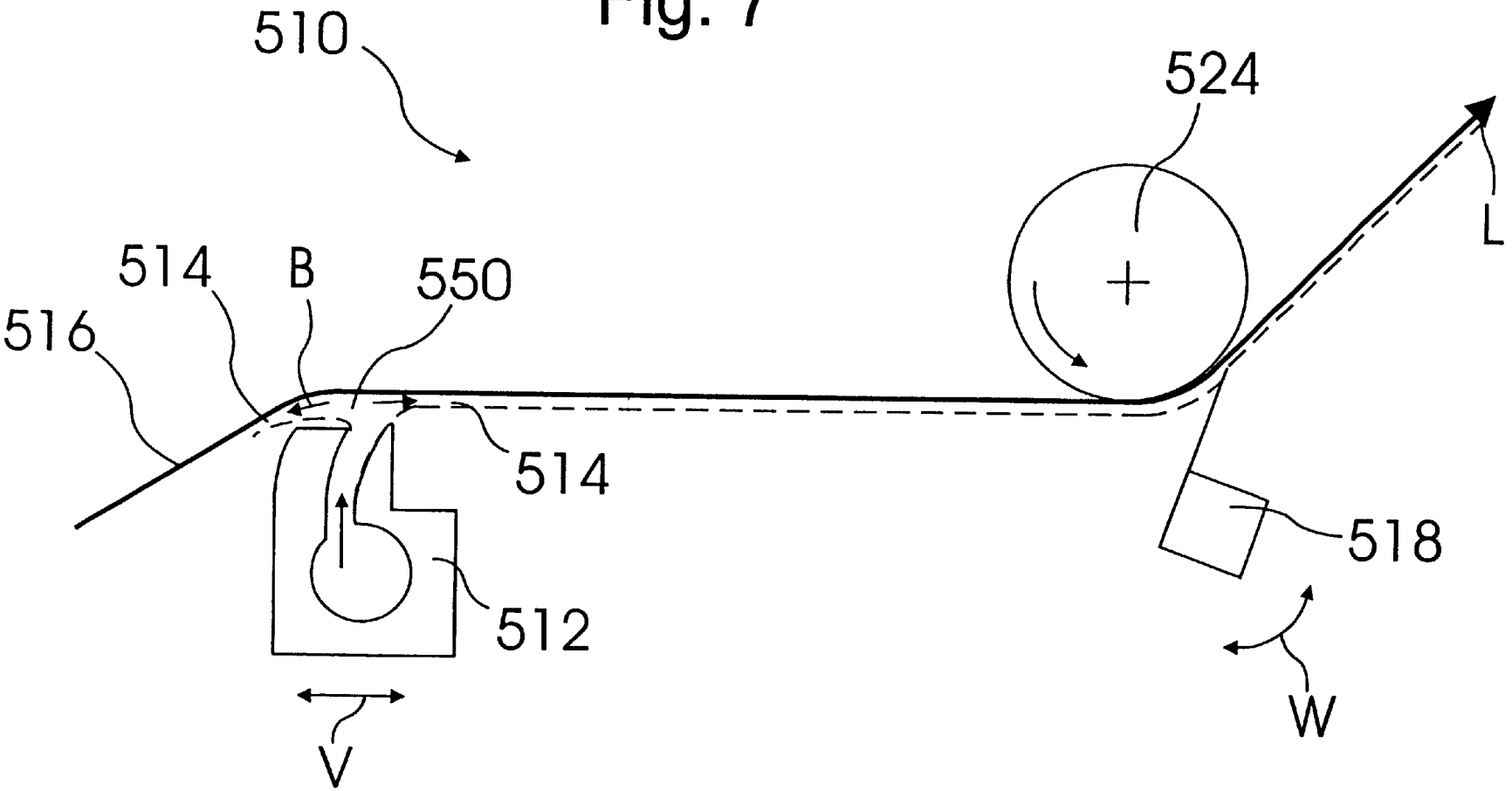
FIG. 7 is a schematic diagram of a still further embodiment of a coater, similar to the one shown in FIG. 5, whereby the coater is also used as a web guide roll.

Coating machine 510, as illustrated in FIG. 7, differs from the coating machine 410 shown in FIG. 5 mainly by the fact that the coater 512 is also absorbing the function of the web guide roll corresponding to web guide element 442 as described in FIG. 5. Similar to the so-called "Air Turn", which facilitates the deflection of the material web on a cushion of air, material web 516, in accordance to the embodiment shown in FIG. 7, is deflected by a cushion formed by the coating medium 514. In this connection, it can be advantageous that the coating medium 514 that is exiting the area of coater 512 not only discharges in direction of feed L, that is, towards the blade coater positioned against support roll 524, but also in the opposite direction of feed L, that is, in the direction as indicated by the arrow B, in order to provide the largest possible contact surface for the material web 516.

Of course, the embodiment shown in FIG. 7 can also accommodate coater 512 and/or blade coater 518 being adjustable in the feed direction L of the material web in order to selectively choose the desired reaction time. For further explanations, reference is made to the elaboration of the embodiments shown in FIGS. 4 through 6.

Figure 8:
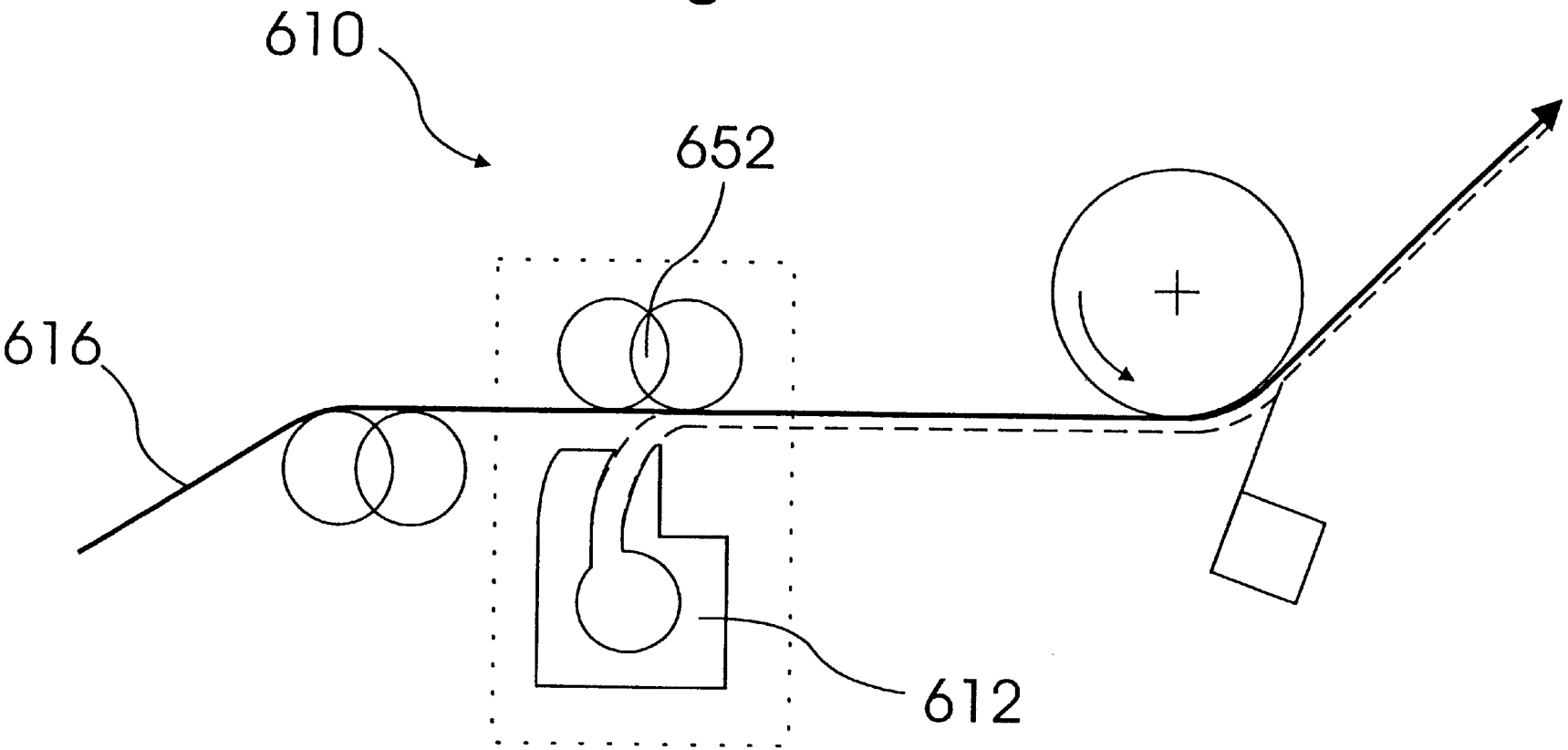
FIG. 8 is a schematic diagram of still yet another embodiment of coater, which includes a spreader roll in the area of the coater to secure the desired tension on the material web.

A further embodiment that secures adequate tension of material web 616 in the area of the coater 612 shall be explained by reference to coating machine 610 shown in FIG. 8. To do so, on the side of the material web 616 opposing the coater 612 resides a spreader roll 652. In principle, other types of rolls such as web guide rolls can also be used in lieu of the spreader roll 652. In addition to providing the desired web tension in the area of the coater, spreader rolls or other rolls having a spreading effect, also have the advantage of offering precise web alignment characteristics. With respect to further details, reference is made to the description of the embodiments shown in FIGS. 4 through 7.

All of the above-discussed embodiments have a reaction length that is free or nearly free of any centrifugal forces between the coater and the metering/smoothing device. To achieve this., the pre-metered application of the coating medium onto the material web and the final metering and smoothing of the coating layer does not take place at the same support element. In the embodiments shown in FIGS. 1 through 3, the application and final metering occur on separate support rolls, while in the embodiments shown in FIGS. 4 through 8, the coating medium is applied onto an area of the pre-tensioned web which does not have any support. The embodiments shown in FIGS. 1 through 3 use a relatively low profile support element in order for all of the above embodiments to be distinguished by a space-saving design.

Moreover, all embodiments offer the capability to adjust the reaction time or reaction length by selectively changing the position of the coater and/or the metering/smoothing device, or more precisely, by laterally repositioning the coater and/or by pivoting the metering/smoothing device around the axis of the support roll. Even though the material web runs horizontally between the coater and the metering/smoothing device in all embodiments, the present invention can also be applied to vertical, inclined or slanted web movements.

Furthermore, it should be noted that all embodiments depict the coater as a free-jet type coater, for example, the type of construction that is offered by Voith-Sulzer under the name "JetFlow F". However, it should be emphasized that other coater types, such as coater rolls, coaters with a closed coating chamber ("JetFlow C") or similar units can be applied. Nevertheless, the free-jet type coating devices are preferred, especially in the embodiments shown in FIGS. 4 through 8, because of the pressure generated by the jet impinging on the material web and the subsequent increase in web tension.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for application of a coating medium onto a moving fiber material web having a direction of movement, said apparatus comprising:

a coater configured for applying the coating medium onto the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll; and a support arrangement at least partially disposed after said coater relative to the direction of movement of the fiber web and configured for supporting the fiber material web substantially entirely along said substantially linear path between said coater and said support roll wherein said support roll is configured for defining a gore with the fiber material web and said support arrangement extends into said gore.

2. The apparatus of claim 1, wherein said support arrangement comprises a substantially stationary support surface configured for contacting the fiber material web.

3. The apparatus of claim 2, wherein said substantially stationary support surface comprises a substantially flat support plate.

4. The apparatus of claim 1, wherein said support arrangement comprises a circulating support belt having a substantially flat outer support surface configured for facing the fiber material web between said coater and said support roll.

5. The apparatus of claim 4, wherein said support belt includes a second surface disposed opposite said outer support surface, said apparatus further comprising at least one saddle disposed adjacent to said second surface of said support belt.

6. The apparatus of claim 1, wherein said support arrangement comprises a support belt, said support roll carrying said support belt at a point whereat said support belt is configured for supporting the fiber material web against said doctor device.

7. The apparatus of claim 1, wherein said support arrangement includes an outer surface facing said support roll, said outer surface substantially conforming to a periphery of said support roll.

8. The apparatus of claim 1, wherein said support arrangement is configured for supporting the fiber material web before said coater relative to the direction of movement of the fiber material web.

9. The apparatus of claim 1, wherein said support arrangement includes a feed-side end having an approach panel.

10. The apparatus of claim 1, wherein said coater comprises a free-jet coating device.

11. The apparatus of claim 1, wherein a position of said coater is adjustable in the direction of movement of the fiber material web.

12. The apparatus of claim 1, wherein said doctor device has an adjustable position about said support roll.

13. The apparatus of claim 1, wherein said doctor device comprises one of a doctor blade, a smooth doctor rod, a profiled doctor rod, and an air knife.

14. An apparatus for application of a coating medium onto a moving fiber material web having a direction of movement, said apparatus comprising:

a coater configured for applying the coating medium onto the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll; and a support arrangement configured for supporting the fiber material web along said substantially linear path between said coater and said support roll, said support arrangement including a textural outer surface configured for generating an air cushion between said textural outer surface and the fiber material web such that said air cushion supports the fiber material web.

15. An apparatus for application of a coating medium onto a moving fiber material web having a width and a direction of movement, said apparatus comprising:

a coater configured for applying the coating medium onto a first side of the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll;

means for stabilizing the fiber material web along said substantially linear path, said stabilizing means being disposed before said doctor device and said support roll relative to the direction of movement of the fiber material web; and a web guide element configured for carrying one of the first side and a second side of the fiber material web before said substantially linear path relative to the direction of movement of the fiber material web, a position of said web guide element being adjustable in the direction of movement of the fiber material web.

16. The apparatus of claim 15, wherein said stabilizing means is furthermore configured for stabilizing the fiber material web before said coater relative to the direction of movement of the fiber material web.

17. The apparatus of claim 15, wherein said web guide element is configured for carrying the first side of the fiber material web before said substantially linear path relative to the direction of movement of the fiber material web.

18. The apparatus of claim 15, wherein said web guide element is configured for carrying a second side of the fiber material web before said substantially linear path relative to the direction of movement of the fiber material web.

19. The apparatus of claim 15, wherein said web guide element comprises an easy-running carrying roll.

20. The apparatus of claim 15, wherein said coater is furthermore configured to form said web guide element, said web guide element being disposed before said coater relative to the direction of movement of the fiber material web.

21. The apparatus of claim 15, wherein said stabilizing means is configured for stabilizing the fiber material web substantially entirely along said linear path to said support roll.

22. The apparatus of claim 15, wherein said coater comprises a free-jet coating device.

23. The apparatus of claim 15, wherein said web guide element is fastened one of directly and indirectly to said coater, said web guide element being disposed before said coater relative to the direction of movement of the fiber material web.

24. The apparatus of claim 15, wherein a position of said coater is adjustable in the direction of movement of the fiber material web.

25. The apparatus of claim 15, wherein said doctor device has an adjustable position about said support roll.

26. An apparatus for application of a coating medium onto a moving fiber material web having a width and a direction of movement, said apparatus comprising:

a coater configured for applying the coating medium onto a first side of the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll;

means for stabilizing the fiber material web along said substantially linear path; and a monolithic web guide element extending substantially across the width of the fiber material web, said web guide element having two opposite ends, each of said ends being supported, said web guide element being configured for carrying one of the first side and a second side of the fiber material web before said substantially linear path relative to the direction of movement of the fiber material web.

27. The apparatus of claim 26, further comprising a plurality of powered support rolls distributed along a length of said web guide element.

28. An apparatus for application of a coating medium onto a moving fiber material web having a width and a direction of movement, said apparatus comprising:

a coater configured for applying the coating medium onto a first side of the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll;

means for stabilizing the fiber material web along said substantially linear path; and a web guide element configured for carrying one of the first side and a second side of the fiber material web before said substantially linear path relative to the direction of movement of the fiber material web, said web guide element comprising a plurality of segments, each said segment having two opposite ends, each of said ends being supported.

29. The apparatus of claim 28, wherein said web guide element comprises a first guide roll, said apparatus further comprising a second guide roll disposed after said first guide roll relative to the direction of movement of the fiber material web, said second guide roll comprising a plurality of segments, said segments of said second guide roll being staggered relative to said segments of said first guide roll in a direction substantially parallel to the width of the fiber material web.

30. An apparatus for application of a coating medium onto a moving fiber material web having a width and a direction of movement, said apparatus comprising:

a coater configured for applying the coating medium onto a first side of the fiber material web;

a doctor device disposed a predetermined distance after said coater relative to the direction of movement of the fiber material web, said doctor device being configured for at least one of metering and smoothing the coating medium;

a support roll configured for carrying and supporting the fiber material web against said doctor device such that the fiber material web moves in a substantially linear path between said coater and said support roll;

means for stabilizing the fiber material web along said substantially linear path;

a first web guide element configured for carrying one of the first side and a second side of the fiber material web before said substantially linear path relative to the direction of movement of the fiber material web; and a second web guide element configured for supporting the fiber material web against said coater.

31. The apparatus of claim 30, wherein said second web guide element comprises a spreader roll.

* * * * *

UNITED STATES PATENT AND TRADEMARK OFFICE

CERTIFICATE OF CORRECTION

PATENT NO. : 6,372,046 B1
DATED : April 16, 2002
INVENTOR(S) : Ingo Gottwald

It is certified that error appears in the above-identified patent and that said Letters Patent is hereby corrected as shown below:

Title page,
Item [56], References Cited, FOREIGN PATENT DOCUMENTS, insert
-- EP 0690 172 A2 1/1996 -- therefor.

Column 4,
Lines 47 and 48, delete.

Column 5,
Line 26, after "arrangement" insert -- 26 -- therefor.
Line 27, after "gore" insert -- , -- and delete "26" therefor.

Column 7,
Line 62, after "monolithe" insert -- , -- therefor.

Column 9,
Line 4, after "this" delete ".." and insert -- , -- therefor.

Signed and Sealed this

Twelfth Day of August, 2003

JAMES E. ROGAN
*Director of the United States Patent and Trademark Office*